United States Patent [19]

Harsch et al.

[11] Patent Number: 4,697,449

[45] Date of Patent: Oct. 6, 1987

[54] SHIFTABLE WORKPIECE GRIPPER FOR A MULTI-STAGE PRESS

[75] Inventors: Erich Harsch, Weingarten; Reiner Reichenbach, Unterankenreute, both of Fed. Rep. of Germany

[73] Assignee: Maschinenfabrik Müller-Weingarten AG, Weingarten, Fed. Rep. of Germany

[21] Appl. No.: 836,627

[22] Filed: Mar. 5, 1986

[30] Foreign Application Priority Data

Mar. 5, 1985 [DE] Fed. Rep. of Germany ..... 3507676

[51] Int. Cl.[4] ..... B21J 13/08

[52] U.S. Cl. ..... 72/405; 72/422; 198/621; 198/740; 198/774; 414/751

[58] Field of Search ..... 72/405, 421, 422; 198/621, 774, 742, 740, 741; 414/751, 753

[56] References Cited

U.S. PATENT DOCUMENTS

| | | | |
|---|---|---|---|
| 3,939,992 | 2/1976 | Mikulec | 198/621 |
| 4,503,969 | 3/1985 | Baba | 198/621 |
| 4,536,118 | 8/1985 | Baba | 198/621 |
| 4,557,133 | 12/1985 | Mikusch et al. | 72/405 |
| 4,557,370 | 12/1985 | Tanaka | 72/405 |

*Primary Examiner*—Daniel C. Crane

*Attorney, Agent, or Firm*—Spencer & Frank

[57] ABSTRACT

A multi-stage press includes support columns; a press stage including tools for deforming a workpiece; an empty stage adjoining the press stage in a direction of a length dimension of the multi-stage press and being situated in a zone of the support columns; a gripper rail being formed of a first gripper rail lenth portion situated in the press stage and a second gripper rail length portion situated in the empty stage; a plurality of workpiece gripper assemblies mounted on the gripper rail; and a tool table normally situated in the press stage and being removable therefrom in a direction transversely to the press length. The workpiece gripper assemblies are independently shiftable relative to one another along the gripper rail and the gripper rail assemblies normally supported on the second gripper rail length portion are shiftable onto the first gripper rail length portion. The gripper rail assemblies have a normal operating position in which the gripper rail assemblies are situated on the first and second gripper rail length portions in a mutually spaced relationship with respect to one another and they have a replacement position in which they are situated solely on the first gripper rail length portion in a mutually contacting relationship with respect to one another.

3 Claims, 6 Drawing Figures

SU 837,594
AU 921

SHIFTABLE WORKPIECE GRIPPER FOR A MULTI-STAGE PRESS

BACKGROUND OF THE INVENTION

This invention relates to multi-stage presses in which generally large workpieces, such as vehicle body parts, are deformed in consecutive press stages while the articles are conveyed from stage to stage and are supported by gripper assemblies. The latter are held on a gripper rail which is formed of a plurality of end-to-end arranged rail portions. Usually, in each press stage there is situated one rail portion whose length generally corresponds to that of the press stage. In case of tool replacement in any press stage, the work tool set of that stage, together with the associated gripper rail portion (which carries the gripper rail assemblies) is rolled out of the press on a table in a direction transversely to the press length. Subsequently, the new tool set is, with the associated gripper rail portion, shifted back into the press stage. For an automatic tool replacement the gripper rail portions associated with the press stage where tool replacement is to be performed, are automatically disconnected from the gripper rail string.

Multi-stage presses, particularly in the zone of supporting columns, have at least one "empty stage" that is, a zone in the sequence of the stages where no work on the workpieces is performed. The workpieces, however, dwell in the empty stages on their way to or from a press stage and therefore have to be positioned by gripper assemblies in the same manner as they are positioned in the press stages. Consequently, when work tool replacement is taking place, particularly because a change in the workpiece is contemplated, the gripper assemblies also have to be replaced and this applies equally to the gripper assemblies that serve the empty stages. It therefore follows that, together with the tool assemblies and the gripper assemblies of the work stage, the gripper assemblies of an adjacent empty stage have to be replaced as well.

According to a known solution in a multi-stage press having a single empty stage, a single gripper assembly is shifted from the empty stage to a rail portion of a press stage preparatory to moving out the tool set and the gripper assemblies of the press stage. Such a known arrangement, however, provides only for a sole gripper assembly to be shifted from a gripper rail portion associated with an empty stage to the gripper rail portion associated with an adjacent press stage. It is further noted that in the prior art, the grippers designed to engage one and the same workpiece have been, on any particular side of the workpiece, formed as one-piece slidable constructions.

SUMMARY OF THE INVENTION

It is an object of the invention to provide an improved arrangement for shifting a plurality of gripper assemblies from a gripper rail portion situated in an empty stage to a gripper rail portion situated in a press stage, particularly with a view toward reliably avoiding collision between grippers.

This object and others to become apparent as the specification progresses, are accomplished by the invention, according to which, briefly stated, the gripper assemblies are segmented structures wherein the individual segments are shiftable on the same track relative to one another and assume a spaced relationship in the working position and a pushed-together, mutually contacting relationship when they assume their position on the gripper rail portion associated with a pressing stage, preparatory to and in the course of the tool replacement process.

DESCRIPTION OF THE PREFERRED EMBODIMENT

Figure 1:
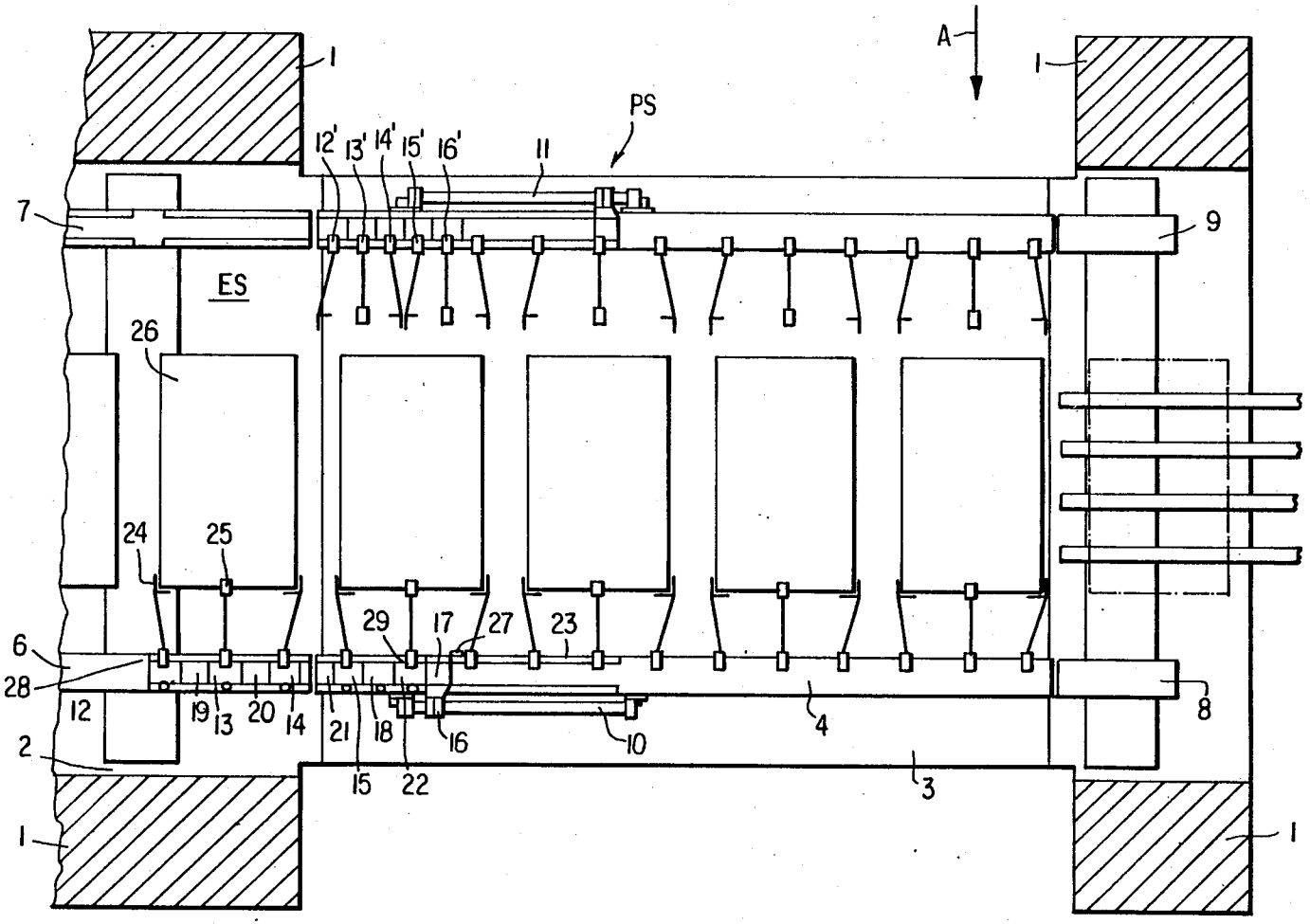
FIG. 1 is a schematic top plan view of a preferred embodiment of the invention showing shiftable components in different positions.

Turning now to FIG. 1, there is shown therein a length portion of a multi-stage press having pairwise arranged press columns 1. The zone between two press columns 1 forming one pair constitutes an empty stage ES whereas the zone between two pairs of press columns 1 is occupied by a press stage PS. On opposite sides of the multi-stage press there extend two gripper rail strings, each formed of a plurality of length portions arranged end-to-end to another. The press stage PS is occupied by a tool tale 3 which supports a work tool set and which also carries the gripper rail length portions 4 and 5. For tool replacement, the table 3 may be rolled out of the multi-stage press in the direction indicated by the arrow A, together with all the components carried thereon. In the empty stage ES the gripper rail portions are designated at 6, 7, 8 and 9.

Each gripper rail string supports a plurality of gripper assemblies (segmented grippers) shiftable thereon. The gripper assemblies 12–16 are shown in their normal working position on the gripper rails 4 and 6 forming part of the gripper rail string on one side of the multi-stage press, whereas the gripper assemblies 12'–16' are shown in the work tool replacement position on the gripper rail portion 5 onto which the gripper assemblies 12', 13' and 14' which are normally associated with the left-hand empty stage ES have been shifted preparatory to tool replacement. To effect tool replacement, the table 3 is rolled out of the multi-stage press.

Figure 3:
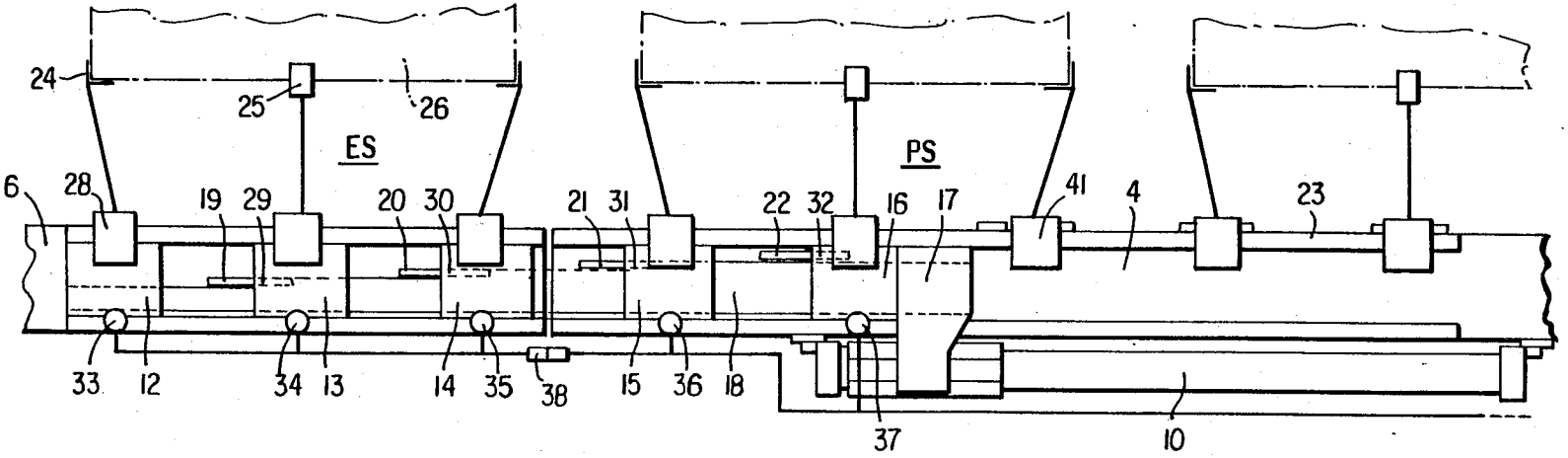
FIG. 3 is a schematic top plan view of one part of the construction shown in FIG. 1, illustrated on an enlarged scale and showing shiftable components in a normal working position.
Figure 5:
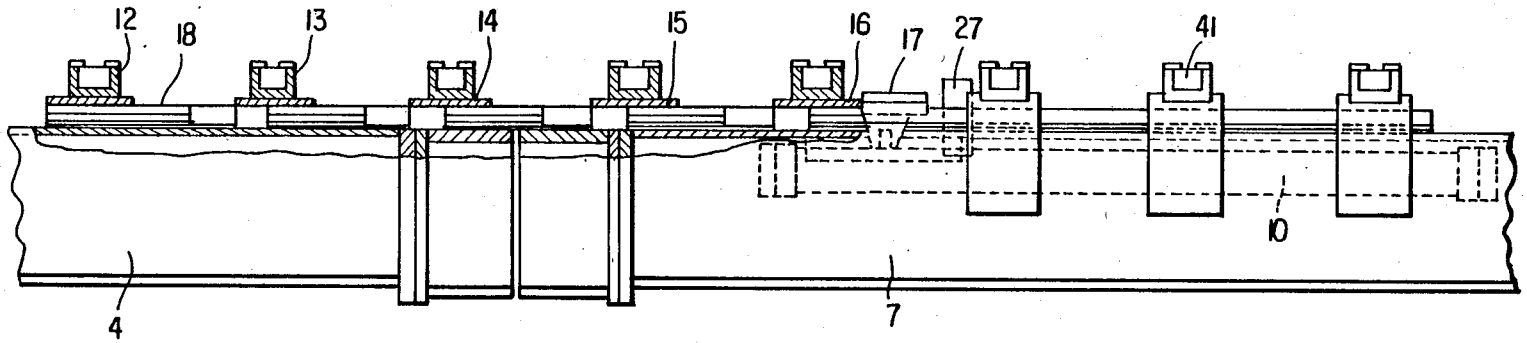
FIG. 5 is a schematic sectional side elevational view of the construction shown in FIG. 3.

Also referring to FIGS. 3 and 5, the gripper assemblies 12–16 are shown in the normal operating position. Each gripper assembly 12–16 includes a gripper holder 28 on which, in turn, there is mounted a gripper 24 or a gripper jaw 25 proper, for engaging the workpieces 26. The grippers 24, 25 proper conventionally serve for transporting the workpieces 26 from work stage to work stage. The grippers 24, 25 are held in the gripper holders 28 by means of a conventional rapid release device (not shown). Thus, in the empty stage ES there are shown the shiftable gripper assemblies 12, 13 and 14. The first shiftable gripper assembly 12 is coupled to a guide part 17 by means of an abutment bar 18 and is shiftable by a hydraulic cylinder 10 axially along a guide bar 23. On the gripper rail portions 4, 6 and 5, 7 there are secured laterally offset abutments 19–22, whereas at the underside of each shiftable gripper assembly 12–16 there is arranged a respective stop 29–32, cooperating with one respective abutment 19–22. The abutment bar 18 is of stepped configuration and cooperates with the stops 29–32.

The shiftable gripper assemblies 13–16 are maintained in their working position by the clamping force exerted by the power cylinder 10, urging the respective shiftable gripper assemblies into engagement with the respective abutment 19–22. In this position, the shiftable gripper assemblies are immobilized (clamped) on the guide bars 23 by hydraulic clamping cylinders 33–37. The hydraulic clamping cylinders 33–37 are charged with pressurized oil by means of a controllable hydraulic coupling 38 situated in the zone 39 of the facing ends of the gripper rail portions 7 and 5. When the connection between the gripper rail portions 7 and 5 is released at the location 39, the hydraulic coupling 38 is automatically released from or connected to the gripper rail lock (not shown).

Figure 2:
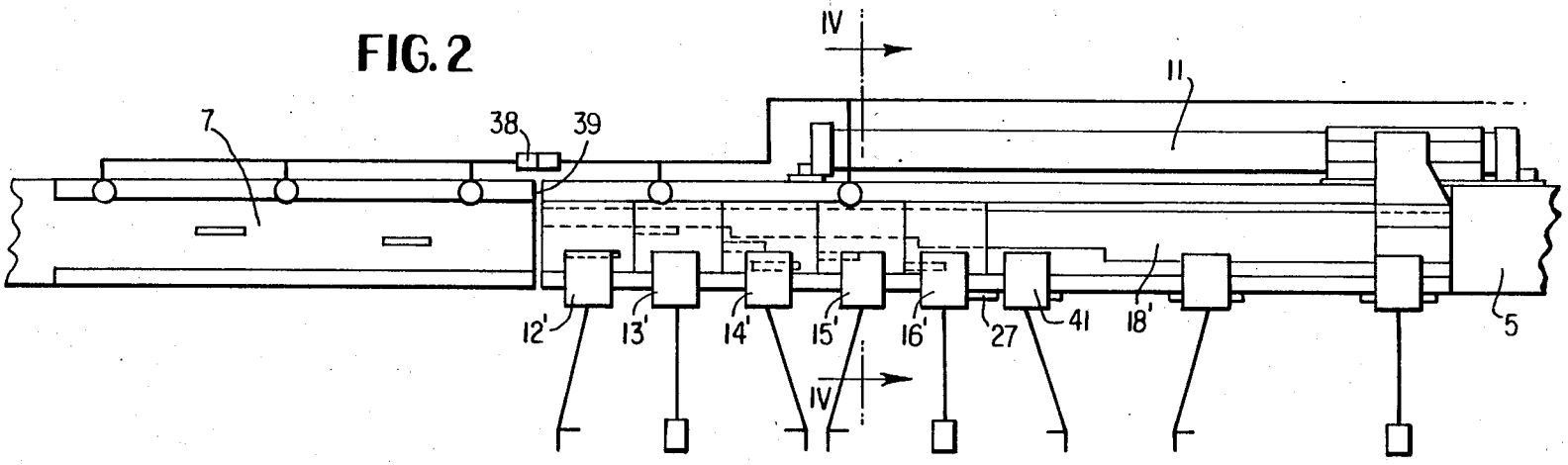
FIG. 2 is a schematic top plan view of one part of the structure shown in FIG. 1, illustrated on an enlarged scale and showing components in a work tool replacement position.
Figure 4:
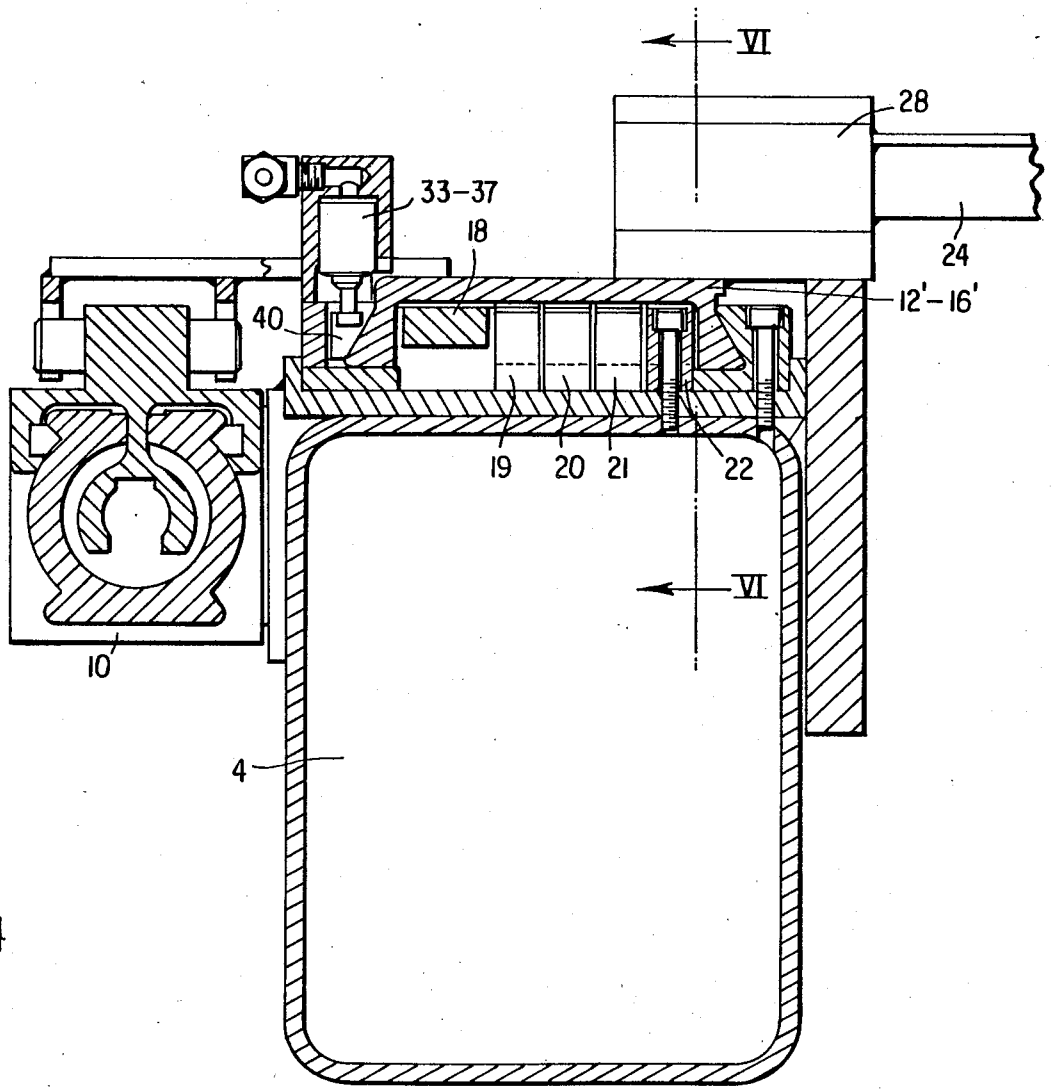
FIG. 4 is an enlarged sectional view taken along line IV—IV of FIG. 2.
Figure 6:
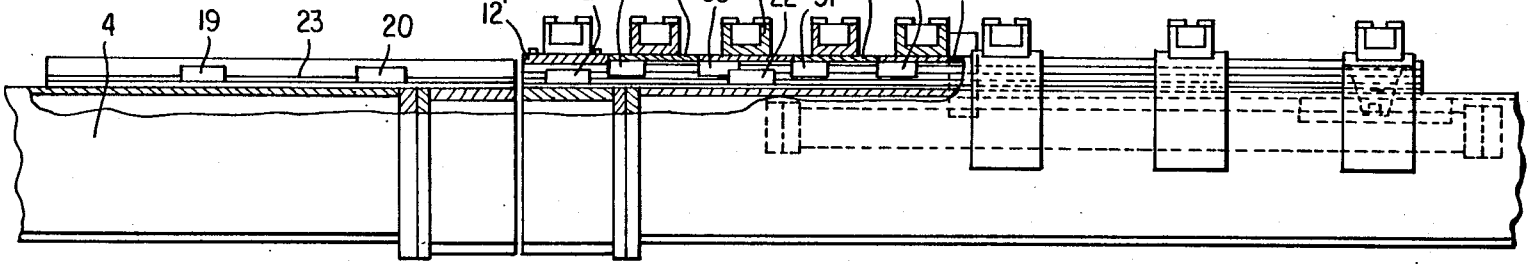
FIG. 6 is a schematic sectional side elevational view taken along line VI—VI of FIG. 4, on a reduced scale with respect thereto.

Preparatory to tool replacement, the shiftable gripper assemblies 13 and 14 associated with the empty stage ES as well as the shiftable gripper assembly 15 associated with the pressing stage PS are pushed towards the right as viewed in FIG. 3 by the first gripper assembly 12, via its abutment bar 18, actuated by the pneumatic cylinder 10 and are brought in a mutually contacting, pushed-together relationship in the press stage as illustrated in FIGS. 2, 4 and 6 for the gripper assemblies 12′–16′ of the other side of the press (which are shifted by another hydraulic power cylinder 11). Thus, according to FIGS. 2, 4 and 6, the left-hand shiftable gripper assembly 12′ presses the other gripper assemblies 13′, 14′, 15′ and 16′ against the abutment 27 by the hydraulic cylinder 11 thus securing the gripper assemblies against displacement.

Thereafter, as it was noted earlier, the table 3 with the tool set and the gripper assemblies as well as the rail portions 3 and 5 (FIG. 1) are moved out in the direction of the arrow A, that is, transversely to the length dimension of the multi-stage press, whereupon the appropriate replacement of the components is performed and subsequently, the table 3 is rolled back into the press stage PS.

Subsequently, the shiftable gripper assemblies 12–16 and 12′–16′ are displaced towards the left by the respective pneumatic cylinders 10 or 11. While initially all the shiftable gripper assemblies move in unison and in mutual contact with one another toward the left, the gripper assemblies are sequentially arrested by the respective stops 19–22 until the gripper assemblies assume their working position as illustrated in FIG. 3. Finally, the gripper assemblies are immobilized by the actuation of the hydraulic clutch 38 to energize the clamping cylinders 33–36 to assume their clamping position.

The gripper assembly 41 and those shown towards the right therefrom in FIGS. 3 and 4 are stationarily mounted on the respective gripper rail 4 and 5 and thus do not participate in the above-described shifting process.

It will be understood that the above description of the present invention is susceptible to various modifications, changes and adaptations, and the same are intended to be comprehended within the meaning and range of equivalents of the appended claims.

What is claimed is:

1. In a multi-stage press including support columns; a press stage including tools for deforming a workpiece; an empty stage adjoining said press stage in a direction of a length dimension of said multi-stage press and being situated in a zone of the support columns; said empty stage being void of tools; a gripper rail extending through said press stage and said empty stage; said gripper rail being formed of a first gripper rail length portion situated in said press stage and a second gripper rail length portion situated in said empty stage; a plurality of workpiece gripper assemblies mounted on said gripper rail; and a tool table normally situated in said press stage and being arranged for removal from said press stage in a direction transversely to said length dimension; said tools and said first gripper rail length portion being mounted on said tool table for displacement therewith as a unit; the improvement wherein said workpiece gripper assemblies are independently shiftable relative to one another along said gripper rail and the workpiece gripper assemblies normally supported on said second gripper rail length portion are shiftable onto said first gripper rail length portion; said workpiece gripper assemblies having a normal operating position in which said workpiece gripper assemblies are situated on said first and second gripper rail length portions in a mutually spaced relationship with respect to one another; said workpiece gripper assemblies having a replacement position in which said workpiece gripper assemblies are situated solely on said first gripper rail length portion in a mutually contacting relationship with repsect to one another; the improvement further comprising a power means situated in said press stage; an abutment bar connected to said power means and to one of said workpiece gripper assemblies being farthest from said power means, whereby said farthest workpiece gripper assembly pushing all said workpiece gripper assemblies together and onto said first gripper rail length portion by a force exerted by said power means on said abutment bar; a plurality of abutments secured to said gripper rail and being spaced from one another parallel to said length dimension; said abutments being arranged in a step-like offset series; and further wherein each said workpiece gripper assembly has a stop cooperating with a respective said abutment for determining normal working positions for each said workpiece gripper assembly on said gripper rail.

2. In a multi-stage press including support columns; a press stage including tools for deforming a workpiece; an empty stage adjoining said press stage in a direction of a length dimension of said multi-stage press and being situated in a zone of the support columns; said empty stage being void of tools; a gripper rail extending through said press stage and said empty stage; said gripper rail being formed of a first gripper rail length portion situated in said press stage and a second gripper rail length portion situated in said empty stage; a plurality of workpiece gripper assemblies mounted on said gripper rail; and a tool table normally situated in said press stage and being arranged for removal from said press stage in a direction transversely to said length dimension; said tools and said first gripper rail length portion being mounted on said tool table for displacement therewith as a unit; the improvement wherein said workpiece gripper assemblies are independently shiftable relative to one another along said gripper rail and the workpiece gripper assemblies normally supported on said second gripper rail length portion are shiftable onto said first gripper rail length portion; said workpiece gripper assemblies having a normal operating position in which said workpiece gripper assemblies are situated on said first and second gripper rail length portions in a mutually spaced relationship with respect to one another; said workpiece gripper assemblies having a replacement position in which said workpiece gripper assemblies are situated solely on said first gripper rail length portion in a mutually contacting relationship with respect to one another; the improvement further comprising a power means situated in said press stage; said power means comprising a hydraulic cylinder; and an abutment bar connected to said power means and to one of said workpiece gripper assemblies being farthest from said power means, whereby said farthest workpiece gripper assembly pushing all said workpiece gripper assemblies together and onto said first gripper rail length portion by a force exerted by said power means on said abutment bar.

3. In a multi-stage press including support columns; a press stage including tools for deforming a workpiece; an empty stage adjoining said press stage in a direction of a length dimension of said multi-stage press and being situated in a zone of the support columns; said empty stage being void of tools; a gripper rail extending through said press stage and said empty stage; said gripper rail being formed of a first gripper rail length portion situated in said press stage and a second gripper rail length portion situated in said empty stage; a plurality of workpiece gripper assemblies mounted on said gripper rail; and a tool table normally situated in said press stage and being arranged for removal from said press stage in a direction transversely to said length dimension; said tools and said first gripper rail length portion being mounted on said tool table for displacement therewith as a unit; the improvement wherein said workpiece gripper assemblies are independently shiftable relative to one another along said gripper rail and the workpiece gripper assemblies normally supported on said second gripper rail length portion are shiftable onto said first gripper rail length portion; said workpiece gripper assemblies having a normal operating position in which said workpiece gripper assemblies are situated on said first and second gripper rail length portions in a mutually spaced relationship with respect to one another; said workpiece gripper assemblies having a replacement position in which said workpiece gripper assemblies are situated solely on said first gripper rail length portion in a mutually contacting relationship with respect to one another; the improvement further comprising a power means situated in said press stage; an abutment bar connected to said power means and to one of said workpiece gripper assemblies being farthest from said power means, whereby said farthest workpiece gripper assembly pushing all said workpiece gripper assemblies together and onto said first gripper rail length portion by a force exerted by said power means on said abutment bar; said abutment bar having a stepped configuration as viewed parallel to said length dimension; said abutment bar being arranged for pushing said workpiece gripper assemblies from the replacement position into contact with respective said abutments in the normal working position as urged by said power means.

* * * * *